United States Patent [19]

Weaver

[11] Patent Number: 4,628,473

[45] Date of Patent: Dec. 9, 1986

[54] SYSTEM FOR AUTOCORRELATING OPTICAL RADIATION SIGNALS

[75] Inventor: James A. Weaver, Palo Alto, Calif.

[73] Assignee: Cooper Lasersonics, Inc., Santa Clara, Calif.

[21] Appl. No.: 635,007

[22] Filed: Jul. 27, 1984

[51] Int. Cl.[4] ..... G06G 7/19

[52] U.S. Cl. ..... 364/822; 350/162.13; 364/845

[58] Field of Search ..... 364/822, 826, 827, 845, 364/713; 350/96.13, 96.14, 162.13, 162.14, 162.15

[56] References Cited

U.S. PATENT DOCUMENTS 4,225,938 9/1980 Turpin ..... 364/822

4,365,310 12/1982 Green ..... 364/822

4,462,046 7/1984 Spight ..... 364/822 X

*Primary Examiner*—Joseph Ruggiero

*Attorney, Agent, or Firm*—C. Michael Zimmerman

[57] ABSTRACT

The invention provides a system with no moving parts for autocorrelating optical radiation signals. An incident optical radiation signal is first divided into first and second optical beams which, in the preferred embodiment, are directed respectively through first and second electro-optic crystals to produce a relative time adjustment between the optical beams. The optical beams are then combined and a product value is determined. Using the technique of autocorrelation, the product of the optical beams is measured over a range of time adjustments between the optical beams to provide a measurement of the incident optical radiation signal. The system and method described provide a vibration-free technique for autocorrelation which can be incorporated into laser resonator structures.

28 Claims, 8 Drawing Figures

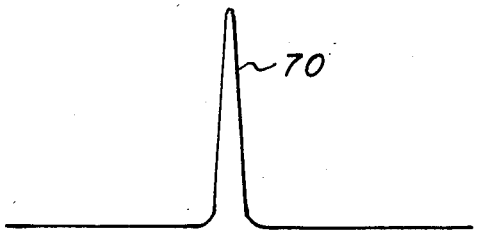
Fig. 2a
FIG. 2b
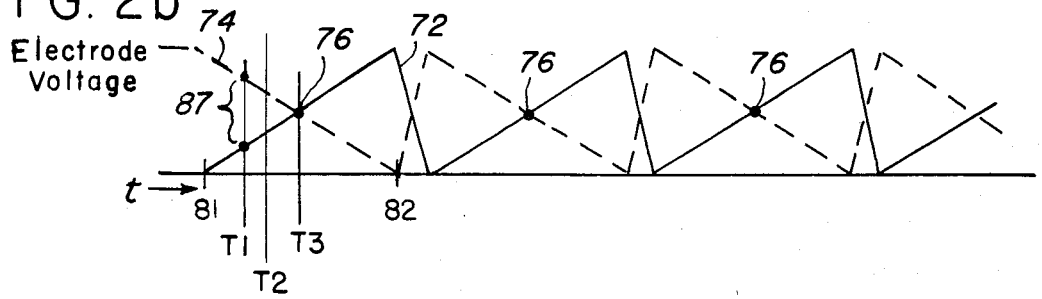
Fig. 2c
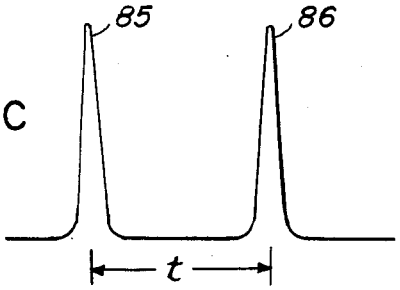
Fig. 2d
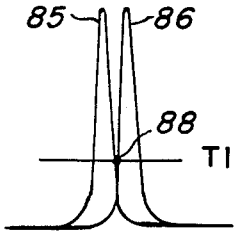
Fig. 2e
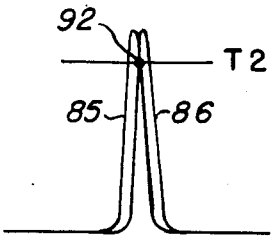
Fig. 2f
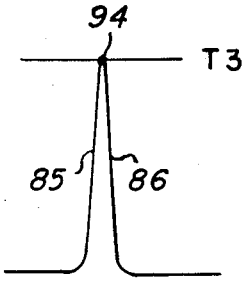
Fig. 2g
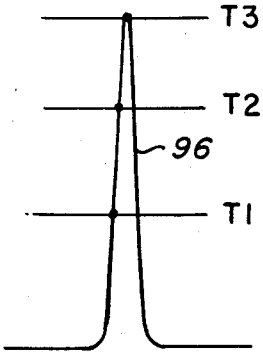

SYSTEM FOR AUTOCORRELATING OPTICAL RADIATION SIGNALS

BACKGROUND OF THE INVENTION

The invention relates to a system and method for measuring periodic optical radiation signals by means of autocorrelation and more particularly to an improved system and method for autocorrelation of optical radiation signals using no moving parts.

In order to produce precise, repeatable pulses of laser radiation having very short durations of less than several picoseconds, it is necessary to accurately measure the laser output, most preferably by analyzing the shape of the pulses. Present laser technology permits the generation of waveforms consisting of pulses in the picosecond range, but such pulses are too short to be measured directly by conventional photodetectors. In order to obtain an accurate picture of such pulses it is necessary to employ a technique known as autocorrelation.

Autocorrelation can briefly be described as a measurement system for developing a composite image of a periodic waveform through multiplication of the measured signal with itself, over a range of time adjustments between the signals multiplied. The measured signal is first divided into two signals, and a time adjustment is introduced between the two signals by delaying one or the other or both signals by selected amounts. The signals are then multiplied together, and the magnitude of the product provides information about the original signal being measured. For laser signals, a beam splitter is used to divide the measured signal into two beams and then one or the other or both beams are directed through a prism or other medium, introducing a slight time adjustment between the beams. The beams are then recombined and a product value is measured. How the product value is used can best be illustrated by describing the measurement of a laser pulse train.

The individual pulses in a pulse train can be thought of as parts of a signal which is zero everywhere except over a very small interval, called the pulse width. When such a signal is multiplied with an identical pulse train which is precisely in phase with the first signal, the product will be another pulse train of essentially equal pulses. If, however, the two pulse trains are out of phase by more than their pulse widths within one, the product signal will be zero. When the pulse trains are out of phase by a fraction of their pulse widths, the product signal will be greater than zero, but less than when the signals exactly coincide. The object of autocorrelation is to produce a series of selected phase mismatches between two pulse beams which are created from the measured signal. At each selected phase mismatch the product is measured. A series of such measurements provides an image of the pulses in the pulse beam, which can then be displayed on an oscilloscope.

Prior art systems for autocorrelating laser and other optical radiation signals make use of varying thicknesses of optical material to produce the relative time adjustments between the optical beams. Optical material delays a beam which is passed through it by an amount dependent on its thickness and index of refraction. To vary the thickness, in most prior art autocorrelators, a pair of beams are directed through a rotating rectangular prism formed of optical material. When the prism is in one position, a short beam path is provided for one beam and a longer path for the other beam. In another position the prism will provide equal length paths through the prism for both beams. Thus, as the prism rotates the beams are delayed by different amount, relative to one another, over a range of such delays. After emerging from the prism, the beams are focused by conventional means on a single point where a product is derived.

While such prior art systems can effectively produce the requisite range of time adjustments between the beams necessary for autocorrelation, they do suffer from certain disadvantages. Because prior art autocorrelators employ a moving prism, a certain amount of mechanical motion and vibration is unavoidable. Even a precisely balanced prism rotating on a single motor shaft will generate mechanical disturbances unacceptably large for use within laser optical cavities. The vibrations produced by the rotating prism make it impossible to mount such an autocorrelator directly on a laser resonator structure. Instead, prior art autocorrelators must be mechanically isolated from the source of the signal being measured. Such isolation requires separate components to be precisely aligned, increasing set-up time and inconvenience.

It would be advantageous to be able to measure to a high degree of accuracy, the pulses generated in a pulse laser without the need for setup and alignment of separate components. More particularly, it would be desirable to be able to incorporate an autocorrelator into a laser resonator structure. Such an autocorrelator must include no moving parts which could generate unacceptable vibrations. Alternatively, a vibration-free autocorrelator could be detachably mounted on a laser resonator, facititating alignment with the laser.

SUMMARY OF THE INVENTION

The invention provides a system for autocorrelating an optical radiation signal. The system includes means for producing a first and a second optical beam from the optical radiation signal, beam delay means for selectively producing a relative time adjustment between the first and second optical beams, and means for determining the product of the optical beams over a range of time adjustments between the optical beams. The beam delay means comprises at least one electro-optic crystal together with means for selectively applying an electric field across the crystal to vary the index of refraction of the crystal. Means are also provided for directing at least one of the optical beams through the electro-optic crystal before determining the product of said optical beams. By providing selected variations in the electric field across the crystal, selected time adjustments are made between the optical beams which permit autocorrelation of the optical radiation signal.

In the preferred embodiment, the invention provides a pair of electro-optic crystals through which the first and second optical beams are directed. Electric fields are applied selectively across the crystals from a periodic signal source, such as a ramp generator. The electric field applied to one crystal varies inversely to the electric field applied to the other crystal to produce a maximum relative time adjustment between the optical beams. The invention further provides a method for autocorrelating an optical radiation signal in accordance with the system described above.

BRIEF DESCRIPTION OF THE DRAWINGS

FIG. 2 is a series of graphical illustrations designated FIGS. *2a* through *2g*, showing selected signals produced within the system for autocorrelating shown in FIG. 1.

DETAILED DESCRIPTION OF THE PREFERRED EMBODIMENT

Figure 1:
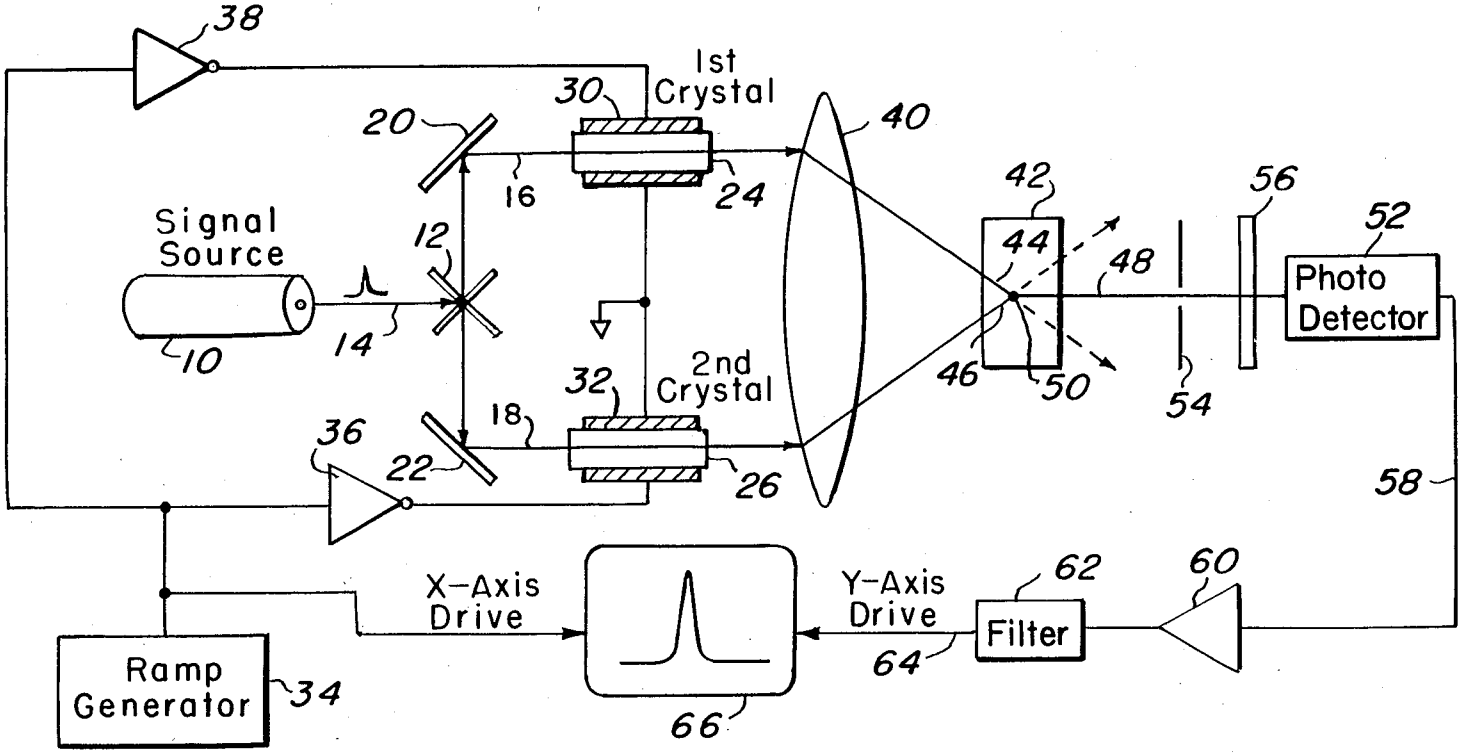
FIG. 1 is a schematic diagram of a system for autocorrelating optical radiation signals in accordance with the present invention.

Referring to FIG. 1, the present invention provides a system for measuring, by means of autocorrelation, a signal produced by an optical radiation source 10, such as a laser. Signal source 10 can be any suitable type of laser and, for the purposes of this description, will be assumed to generate a periodic signal consisting of a series of narrow pulses. The output of signal source 10 is first supplied to a conventional beam splitter 12. The beam splitter serves as a means for dividing the original optical radiation signal 14 into a first optical beam 16 and a second optical beam 18. By means of suitable mirrors 20 and 22 the respective first and second beams 16 and 18 are directed through a pair of electro-optic crystals. First beam 16 is directed through a first electro-optic crystal 24 and second beam 18 is directed through a second electro-optic crystal 26. Electro-optic crystals 24 and 26 are formed of a material which changes its index of refraction in response to an externally applied transverse electric field. Crystals formed of various material which exhibit this property are used in the laser field. One such material is potassium dihydrogen phosphate (KDP). Crystals 24 and 26 are used to alternately delay one or the other or both optical beams 16 and 18 in order to produce a time adjustment between the first and second beams for autocorrelation.

Electro-optic crystals 24 and 26 are each provided with external opposing electrodes, positioned adjacent the crystals. First crystal 24 is provided with a pair of first electrodes 30, and second crystal 26 is provided with a pair of second electrodes 32. Electrodes 30 and 32 are energized independently of one another by a system which includes a ramp generator 34 for generating a periodic waveform and a pair of high voltage drivers 36 and 38 which amplify the output of ramp generator 34 to the voltages necessary. Although the voltages required to produce an electrooptic adjustment in the index of refraction of the crystals will depend on many factors, including crystal dimensions and the magnitude of the time adjustments to be made, such voltages will generally be on the order of several kilovolts.

The illustrated shapes and dimensions of electro-optic crystals 24 and 26 in FIG. 1 should be considered to be for schematic purposes only. The shape of the crystals will be determined by factors such as the wavelength of the optical radiation signal, the amount of delay to be produced, the need to minimize scatter, reflection and attenuation of the beams, and design choice. Similarly, the shapes and configurations of the electrodes positioned adjacent the crystals are a matter of design choice, and the electrodes shown in FIG. 1 should be considered to be schematic only.

After passing through crystals 24 and 26, first and second beams 16 and 18 are combined in order to permit measurement of the product of the beams. For this purpose, a suitable optical focusing device such as lens 40 can be used to redirect the beams along paths which converge at a selected location. Positioned at the selected location where the beams converge, is another crystal 42 of a type suitable for combining optical beams to yield a product beam. Such a crystal, termed herein a multiplying crystal, could be of the type used in prior art systems. Multiplying crystal 42 has the ability to receive incoming beams along angled paths, illustrated at 44 and 46 in FIG. 1. Thus, when first and second optical beams 16 and 18 are focused along respective paths 44 and 46 by lens 40, they converge and intersect at a point 50 within crystal 42. There, the beams combine to produce a product beam 48 having a magnitude proportional to the product of first and second optical beams 16 and 18.

In order to measure the magnitude of product beam 48, a photodetector 52 is positioned along its path. Before reaching photodetector 52, product beam 48 can be directed through suitable beam filtering and processing devices, such as aperture 54 which eliminates scattered radiation and filter 56 which eliminates certain of the frequencies of the radiation.

The output of photodetector 52 is a signal on line 58 having a magnitude proportional to the product of the first and second beams, adjusted in time by the autocorrelator of the present invention. Photodetectors 52 will not have a sufficiently fast response time to exactly reproduce the waveform of a short pulse in the nanosecond range, but will output a varying waveform having a magnitude proportional to resultant beam 48. The output signal on line 58 is first supplied to a suitable amplifier 60 and a low pass filter 62 which will smooth the signal on line 64. The signal is then supplied to a suitable signal display means such as an oscilloscope 66. If the magnitude signal is supplied to the y axis drive of the oscilloscope, the ramp generator output can be supplied to the x axis input of the oscilloscope to yield an image of the pulse output from signal source 10. The technique for coordinating the relative time adjustments between the beams with the magnitude measurements to produce an image of the measured signal 14 will be described below.

FIG. 2 illustrates the technique for autocorrelating a signal in accordance with the present invention. FIG. *2a* shows a single pulse 70 output from signal source 10, Pulse 70 is one of a sequence of such pulses which are emitted as a pulse train by laser 10. The pulse train is split by beam splitter 12 into first and second optical beams 16 and 18, respectively. The first and second optical beams are then directed through the respective first and second electro-optic crystals 24 and 26. Since the crystals have a higher index of refraction than the surrounding medium (air), the optical beams will be delayed in time by a certain amount regardless of whether a transverse electric field is applied across the crystals. If no electric field is applied to the crystals, or if an equal field is applied across both crystals 24 and 26, the amount of delay introduced in the first and second optical beams will be equal, assuming the beams travel an equal length through the crystal material.

By applying electric fields across the crystals, the index of refraction of the crystal material can be varied. The change in the index of refraction depends on the intensity of the electric field. An increase in the index of refraction of an electro-optic crystal correspondingly increases the delay time for the transit of an optical beam through the crystal. Consequently, an applied electric field varying between predetermined limits will produce delays in the optical beam varying between a minimum and a predetermined maximum value. In the embodiment of FIG. 1, ramp generator 34 provides the signal for controlling the voltages applied to crystals 24 and 26.

An illustrative example of the variations in the voltages applied to the crystals is shown in FIG. 2*b*. Line 72 which varies between a predetermined minimum and maximum voltage represents the voltage applied to first electro-optic crystal 24.

The effect of the time varying electric fields applied to crystals 24 and 26 is illustrated in FIG. 2*c* through 2*f*. FIG. 2*c* shows the condition that exists at point 81 in FIG. 2*b*. Here, the time difference t between pulses 85 and 86 is large enough that there is no overlap between pulses 85 and 86 arriving at the multiplying crystal, 42 in FIG. 1. The resulting product is everywhere zero.

FIG. 2*d* illustrates the condition existing at time T1 in FIG. 2*b*. The time delay is such that a certain amount of overlap exists between pulses 85 and 86. The resulting product reaches a maximum corresponding to the maximum value of overlap, point 88 in FIG. 2*d*. Similarly, the condition at times T2 and T3 in FIG. 2*b* are shown in FIGS. 2*c* and 2*f*, respectively. At time T2 there is more overlap between pulses 85 and 86 than at time T1. The resulting product reaches a greater value at point 92 in FIG. 2*e* than at point 88 in FIG. 2*d*. At time T3 in FIG. 2*b*, pulses 85 and 86 coincide and the largest product is obtained, point 94 in FIG. 2*f*.

From point 76 to point 82 in FIG. 2*b*, the sequence of conditions reverses, proceeding from that shown in FIG. 2*f* to that shown in FIGS. 2*c*, then FIG. 2*f*, and reaching that shown in FIG. 2*c* at point 82 of FIG. 2*b* with the position of pulses 85 and 86 reversed throughout.

It is assumed during the operation of the autocorrelator that the frequency of the pulses carried by the first and second optical beams 16 and 18 will be substantially higher than the frequency of the periodic signal output by ramp generator 34 In other words, the ramp generator signal will change slowly with respect to the pulses being measured. Therefore, as the signals applied to the crystals change in the manner shown in FIG. 2*b*, a continuously changing value of the product signal measured by photodetector 52 will be produced. The signal output by the photodetector and carried on line 58 will consist of a series of pulses at the pulse frequency of signal source 10. The height or magnitude of the pulses output by the photodetector will vary as the relative time adjustments between the first and second optical beams varies. Low pass filter 62 will smooth the signal from the photodetector to produce a continuous signal which is supplied to the y axis drive of an oscilloscope or other displayed device.

FIG. 2*g* shows a respresentative example of the image which would be carried on an oscilloscope screen in the above-described example. The levels represented by times T1, T2 and T3 represent the magnitude of the product signal as measured by photodetector 52 at those specific times in each cycle of the ramp generator. The resultant curve 96 provides an image of the pulses being output by signal source 10.

The technique of autocorrelation provides a means for determining the shape of pulses which are too short to measure directly. Through use of an oscilloscope, the autocorrelated signal can be displayed, and appropriate adjustments can be made to the signal source in order to produce the form of pulse desired. If the pulses are generated by a laser, the image produced through autocorrelation can be used to fine tune the cavity length or make other signal refining adjustments until the curve attains the desired shape.

Although the preferred embodiment of the invention includes a pair of electro-optic crystals which are used to simultaneously vary the split optical beams by different amounts, other configurations are possible within the scope of the present invention. A single electro-optic crystal could be employed to adjust one or the other of the split optical beams by selected amounts, for example. One of the optical beams could be passed through a crystal without electrodes to provide a fixed predetermined delay while the other beam is directed through a crystal having electrodes to produce a varying time adjustment. In embodiments employing only a single crystal with electrodes to vary the delay in one of the optical beams, the effect of a relative time adjustment between the beams will be produced in essentially the same manner as in the embodiment of FIG. 1. The signals are subsequently combined and a product value is measured which can be converted to an image of the pulses.

The autocorrelating system of the present invention has numerous advantages over prior art autocorrelators which employ rotating prisms or other moving parts. Because the present invention has no moving parts, it can be installed within or attached to a laser resonator structure without introducing unacceptable vibrations into the laser cavity. Since lasers are designed to generate coherent radiation at fixed, selected wave lengths, the attachment of a source of vibration, such as a rotating prism autocorrelator, to the resonator structure, is unacceptable. To completely isolate a source of vibration from the laser cavity, as is necessary with prior art autocorrelators, requires the use of separate parts on vibration-free tables or the like. That, in turn, requires precise alignment of the various parts which, can be laborious and time consuming. The autocorrelator of the present invention has no moving parts and can therefor be mounted directly on the laser resonator structure in a pre-aligned position. Another advantage of the present invention is its simplified control circuitry. Whereas with a rotating prism it is necessary to employ position detectors which measure the position of the prism to a high degree of accuracy, the present invention has no such requirement. In fact, the oscilloscope x axis signal can be taken directly from the ramp generator, as shown in FIG. 1. The amount of delay introduced in each of the split optical beams is directly related to the signal output of the ramp generator.

Other variations are possible within the scope of the present invention. The ramp signal used to produce the variations in the electric fields across the crystals is illustrative only, and other waveforms could be used to control the transverse electric fields. For crystals which exhibit nonlinearity in the variation in index of refraction, it might be desirable to apply a compensating waveform which produces a linear time adjustment in the optical beam. The manner in which the split optical beams are combined to yield product signal shown in FIG. 1 is also intended to be illustrative and variations will occur to those skilled in the art. It is also possible to envision alternate techniques for displaying or utilizing the product signal within the scope of the present invention.

The autocorrelator of the present invention is able to measure to a high degree of accuracy the pulses generated in a pulse laser without the need for setup and alignment of separate components. The autocorrelator can be incorporated into a laser resonator structure. In addition the autocorrelator includes no moving parts and therefor generates no vibrations.

What is claimed is:

1. A system for autocorrelating an optical radiation signal comprising means for producing a first optical beam and a second optical beam from said optical radiation signal; beam delay means for selectively producing a relative time adjustment between said first and second optical beams; and means for determining the product of said optical beams over a range of time adjustments between said optical beams to provide a measurement of said optical radiation signal, said beam delay means comprising at least one electro-optic crystal, means for selectively applying an electric field across said crystal to vary the index of refraction of said crystal, and means for directing at least one of said optical beams through said electro-optic crystal before determining the product of said optical beams such that selected variations in the electric field across said crystal produce selected time adjustments between said optical beams.

2. A system as in claim 1 in which said beam delay means further includes first and second electro-optic crystals and means for directing said first optical beam through said first crystal and for directing said second optical beam through said second crystal prior to determining the product of said optical beams, and means for selectively applying electric fields across said first and second crystals.

3. A system as in claim 2 in which said means for selectively applying electric fields includes means for applying a first varying electric field to one of said crystals and for simultaneously applying a second varying electric field which varies inversely to said first varying electric field to the other of said crystals.

4. A system for measuring an optical radiation signal by means of autocorrelation, comprising: means for producing a first optical beam and a second optical beam from said optical radiation signal, beam delay means for selectively producing a relative time adjustment between said first and second optical beams, said beam delay means including at least one electro-optic crystal, means for selectively applying an electric field across said crystal to vary the index of refraction of said crystal, and means for directing at least one of said optical beams through said electo optic crystal to delay said at least one of said optical beams by an amount dependent on the electric field applied across said crystal, means for combining said first and second optical beams to produce a resultant signal proportional to the product of said optical beams, and signal measuring means for measuring changes in said resultant signal in response to changes in said applied electric field to provide a measurement of said optical radiation signal over a selected time interval.

5. A system as in claim 4 in which said beam delay means further includes a first and a second electro-optic crystal and means for directing said first optical beam through said first crystal and for directing said second optical beam through said second crystal prior to supplying said optical beams to said means for combining, and means for selectively applying electric fields across said first and second crystals.

6. A system as in claim 5 in which said means for selectively applying electric fields includes means for applying a first varying electric field to one said crystal and for applying a second varying electric field which varies inversely to said first varying electric field to the other said crystal.

7. A system as in claim 4 in which said means for combining said first and second optical beams includes means for directing said first and second optical beams to a selected location at which said optical beams converge, and including a multiplying crystal located at said selected location where said first and second optical beams converge, such that a resultant beam is produced in said multiplying crystal which is proportional to the product of said first and second optical beams.

8. A system as in claim 7 in which said signal measuring means includes a photodetector and means for directing said resultant beam from said multiplying crystal to said photodector.

9. A system as in claim 4 in which said means for selectively applying an electric field across said electro-optic crystal includes a ramp generator for producing a periodic waveform, a high voltage source operated in response to the output of said ramp generator, and electrodes connected to said high voltage source positioned on opposite sides of said electro-optic crystal for applying an electric field across said electro-optic crystal operated in response to the output of said ramp generator.

10. A system of autocorrelating an optical radiation signal comprising means for producing a first optical beam and a second optical beam from said optical radiation signal, first and second electro-optic crystals through which said first and second optical beams are respectively directed, means for selectively applying an electric field across said crystals for varying the index of refraction of each of said crystals to produce relative time adjustments between said first and second optical beams, and means for determining the product of said optical beams over a range of time adjustments between said optical beams to provide a measurement of said optical radiation signal.

11. A system for autocorrelating as in claim 10 in which said means for selectively applying an electric field across said first and second electro-optic crystals includes first electrodes for applying an electric field across said first crystal and second electrodes for applying an electric field across said second crystal and periodic signal means for applying a first periodic signal to said first electrodes and for applying to said second electrodes a second periodic signal which varies inversely to said first periodic signal.

12. A system for autocorrelating as in claim 11 in which said means for determining the product of said optical beams includes means for combining said first and second optical beams to produce a resultant signal proportional to the product of said optical beams, said system further including signal measuring means for measuring said resultant signal, and including means for supplying the periodic signal produced by said periodic signal means to said signal measuring means to permit coordination of the relative time adjustments between said first and second optical beams with the measurements of the magnitude of said resultant signal whereby a measurement of said optical radiation signal over a selected time interval is provided.

13. A system for autocorrelating as in claim 12 in which said means for combining said first and second optical beams includes means for directing said first and second optical beams to a selected location at which said optical beams coverage, and including a multiplying crystal located at said selected location where said first and second optical beams coverage, wherein a resultant beam is produced in said multiplying crystal which is proportional to the product of said first and second optical beams.

14. A system for autocorrelating as in claim 10 in which said means for selectively applying an electric field across said crystals applies a first varying electric field to one said crystal and simultaneously applies a second varying electric field which varies inversely to said first varying electric field to the other said crystal.

15. A system for autocorrelating as in claim 14 in which said means for combining said first and second optical beams includes means for directing said first and second optical beams to a selected location at which said optical beams converge, and including a multiplying crystal located at said selected location where said first and second optical beams converge, wherein a resultant beam is produced in said multiplying crystal which is proportional to the product of said first and second optical beams.

16. A system for autocorrelating as in claim 15 in which said means for determining the product of said optical beams further includes a photodetector and means for directing said resultant beam produced in said multiplying crystal to said photodetector.

17. A system for autocorrelating as in claim 16 further including display means for displaying the magnitude of said resultant beam as detected by said photodetector, and including means for supplying a signal from said means for selectively applying an electric field across said crystals to said display means to permit coordination of the relative time adjustments between said first and second optical beams with the measurements of the magnitude of said resultant signal whereby a measurement of said optical radiation signal over a selected time interval is produced.

18. A system for autocorrelating as in claim 10 together with a resonator structure on which is mounted a source of said optical radiation signal, said means for producing a first optical beam and a second optical beam from said optical radiation signal, and said first and second electro-optic crystals whereby a single resonator structure supports both the optical radiation source and the autocorrelation system for measuring the optical radiation signal.

19. A method of autocorrelating an optical radiation signal by steps which include producing a first optical beam and a second optical beam from said optical radiation signal, selectively producing a relative time adjustment between said first and second optical beams, and determining the product of said optical beams over a range of time adjustments between said optical beams to provide a measurement of said optical radiation signal, wherein said step of selectively producing a relative time adjustment between said first and second optical beams comprises the steps of: directing at least one of said optical beams through an electro-optic crystal having an index of refraction which is variable in response to an electric field applied across said electro-optic crystal, and selectively applying a varying electric field across said electro-optic crystal to produce a selected time adjustment between said first and second optical beams.

20. A method of autocorrelating as in claim 19 in which said step of selectively producing said relative time adjustment between said optical beams further includes directing said first optical beam through a first electro-optic crystal and directing said second optical beam through a second electro-optic crystal, and applying a first varying electric field to one said crystal and simultanteously applying a second varying electric field which varies inversely to said first varying electric field to the other said crystal.

21. A method of autocorrelating as in claim 20 in which said step of determining the product of said optical beams includes the steps of directing said first and second optical beams to a selected location at which said optical beams converge, and providing a multiplying crystal at said selected location where said first and second optical beams converge, wherein a resultant beam is produced in said multiplying crystal which is proportional to the product of said first and second optical beams.

22. A method of autocorrelating as in claim 21 in which said step of determining the product of said optical beams further includes directing said resultant beam produced in said multiplying crystal to a photodetector for measuring the magnitude of said resultant beam.

23. A method of autocorrelating an optical radiation signal comprising the steps of producing a first optical beam and a second optical beam from said optical radiation signal, directing said first and second optical beams through respective first and second electro-optic crystals, selectively applying electric fields across said electro-optic crystals to vary the index of refraction of each of said crystals whereby relative time adjustments between said first and second optical beams are produced, and determining the product of said optical beams over a range of relative time adjustments between said optical beams to provide a measurement of said optic radiation signal.

24. A method of autocorrelating as in claim 23 in which said step of selectively applying electric fields across said electro-optic crystals includes applying a first varying electric field to said first electro-optic crystal and simultaneously applying a second varying electric field which varies inversely to said first varying electric field to said second electro-optic crystal.

25. A method of autocorrelating as in claim 24 in which said step of selectively applying electric fields across said electro-optic crystals further includes providing a ramp generator for producing a periodic waveform for controlling said first and second varying electric fields.

26. A method of autocorrelating as in claim 23 in which said step of determining the product of said optical beams includes the steps of directing said first and second optical beams to a selected location at which said optical beams converge, and providing a multiplying crystal at said selected location where said first and second optical beams converge wherein a resultant beam is produced in said multiplying crystal which is proportional to the product of said first and second optical beams.

27. A method of autocorrelating as in claim 26 in which said step of determining the product of said optical beams further includes directing said resultant beam produced in said multiplying crystal to a photodetector for measuring the magnitude of said resultant beam.

28. A method of autocorrelating as in claim 27 in which said step of selectively applying electric fields across said electro-optic crystals includes the steps of producing a periodic signal for controlling said electric fields and directing the output of said photodetector to signal display means for displaying the magnitude of said resultant signal, and additionally supplying said periodic signal to said signal display means to permit coordination of the relative time adjustments between said first and second optical beams with the measurements of the magnitude of said resultant signal whereby a measurement of said optical radiation signal over a selected time interval is provided.

* * * * *